US006225731B1

(12) United States Patent
Auyang

(10) Patent No.: US 6,225,731 B1
(45) Date of Patent: May 1, 2001

(54) GLASS HALOGEN LAMP WITH INTERNAL ELLIPSOIDAL SHROUD

(75) Inventor: Lun Auyang, Pleasanton, CA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/169,557

(22) Filed: Oct. 9, 1998

Related U.S. Application Data

(60) Provisional application No. 60/061,513, filed on Oct. 10, 1997.

(51) Int. Cl.[7] ..... H01J 1/02; H01J 61/52; H01J 7/24; H01K 1/58

(52) U.S. Cl. ..... 313/25; 313/17; 313/634; 313/292

(58) Field of Search ..... 313/25, 17, 26, 313/313, 116, 578, 529, 112, 635, 636, 113, 634, 110, 292

(56) References Cited

U.S. PATENT DOCUMENTS 4,547,704 * 10/1985 Brinn et al. ..... 313/635
5,043,623 * 8/1991 Scholz et al. ..... 313/25
5,051,657 * 9/1991 Bazin et ..... 315/73
5,138,219 * 8/1992 Krisl et al. ..... 313/112
5,466,987 * 11/1995 Williamson ..... 313/25
5,493,167 * 2/1996 Mikol et al. ..... 313/25
5,528,107 * 6/1996 Morlor et al. ..... 313/112
5,550,421 * 8/1996 Scholz et al. ..... 313/25
5,557,171 * 9/1996 Marlor et al. ..... 313/112
5,576,598 * 11/1996 Zaslavsky et al. ..... 313/25
5,578,892 * 11/1996 Whitman et al. ..... 313/112
5,587,626 * 12/1996 Parham et al. ..... 313/635
5,610,469 * 3/1997 Bergman et al. ..... 313/25
5,670,840 * 9/1997 Lanese et al. ..... 313/25
5,719,463 * 2/1998 Hassink et al. ..... 313/25
5,723,937 * 3/1998 Whitman et al. ..... 313/116
5,982,078 * 11/1999 Krisl et al. ..... 313/112

* cited by examiner

*Primary Examiner*—Michael H. Day
*Assistant Examiner*—Mariceli Santiago
(74) *Attorney, Agent, or Firm*—Fay, Sharpe, Fagan, Minnich & McKee, LLP

(57) ABSTRACT

A single-ended glass halogen lamp includes an infrared reflecting shroud surrounding a lamp filament which reflects infrared energy back to the lamp filament to heat the filament and improve overall lamp efficiency. The shroud is supported within the lamp enclosure by the electrical leads which connect the lamp filament to a source of electricity. The optical interference filter is preferably a tantala-silica coating formed on an exterior of an ellipsoidal shaped shroud.

19 Claims, 2 Drawing Sheets

GLASS HALOGEN LAMP WITH INTERNAL ELLIPSOIDAL SHROUD

This application claims the benefit of Provisional No. 60/061,513, filed Oct. 10, 1997.

BACKGROUND OF THE INVENTION

The invention relates to the field of glass halogen lamps and, more particularly, to a glass halogen lamp with an internally mounted shroud for reflecting infrared radiation back to the lamp filament.

Thin film optical interference coatings, known as interference filters, including alternating coating layers of two or more materials having different refractive indices, are used in the illumination field to selectively reflect and/or transmit light of different wavelengths. Interference coatings can be used to transmit various portions of the electromagnetic spectrum, such as visible light, while reflecting other portions of the electromagnetic spectrum, such as ultraviolet or infrared radiation. These interference coatings are used in the lamp industry to coat Reflectors and/or lamp envelopes to achieve desirable illuminance patterns and to filter out undesirable energy.

Thin film optical coatings have been used on lamp enclosures to improve the illumination efficiency of incandescent lamps by reflecting infrared energy emitted by a filament back to the filament while transmitting the visible light portion of the electromagnetic spectrum emitted by the filament through the enclosure. The reflected infrared radiation heats the filament and reduces the amount of electrical energy required to maintain the filament operating temperature. Thus, the infrared reflective coating increases the illumination provided by a lamp for the same amount of energy input. The infrared reflective optical coatings can also improve the efficiency of an arc lamp in substantially the same manner.

One example of the use of an optical interference coating for reflecting infrared radiation in a halogen lamp is described in U.S. Pat. No. 5,138,219. The thin film infrared reflecting, optical interference filter is coated onto the outer surface of the lamp envelope to reflect infrared energy back to the filament. Although this glass halogen infrared reflecting lamp provides a benefit of improved lamp efficiency, it is relatively expensive to manufacture due to the large amount of coating material used to coat the enclosure and due to difficulties in mounting the lamp within the parabolic reflector.

It would therefore be desirable to provide an efficient lamp with an infrared coating which is less expensive to manufacture and easier to mount than the known lamps.

SUMMARY OF THE INVENTION

The present invention contemplates a new and improved single-ended glass halogen lamp which takes advantage of an infrared coating for maximum energy savings and also provides lower cost manufacturing than the known lamps.

In accordance with the present invention, a glass halogen lamp includes a lamp filament, a light transmissive lamp enclosure surrounding the lamp filament, and first and second electrical leads electrically connected to opposite ends of the lamp filament and both extending from a first side of the lamp enclosure. An ellipsoidal shroud is positioned about the lamp filament between the filament and the enclosure and a light-transmissive, infrared energy reflecting coating is formed on the ellipsoidal shroud to reflect infrared energy generated by the filament back to the filament to improve an efficiency of the lamp.

In accordance with a more limited aspect of the invention, at least one of the first and second electrical leads functions to support the ellipsoidal shroud within the enclosure.

In accordance with a further aspect of the present invention, an electrical lamp includes an electric light source, a shroud coated with an optical interference coating which reflects infrared radiation and transmits visible light, the shroud surrounding the light source and reflecting the infrared radiation emitted by the light source back to the light source, a hermetically sealed envelope surrounding the shroud, and an inert gas disposed within the envelope and surrounding the shroud and filament.

The principal advantages of the invention are energy savings provided by the infrared reflecting coating, low cost manufacturing due to the shroud and the single-ended lamp configuration, and ease of mounting.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in this specification and illustrated in the accompanying drawings which form a part hereof, and wherein.

DETAILED DESCRIPTION OF THE PREFERRED EMBODIMENTS

Figure 1:
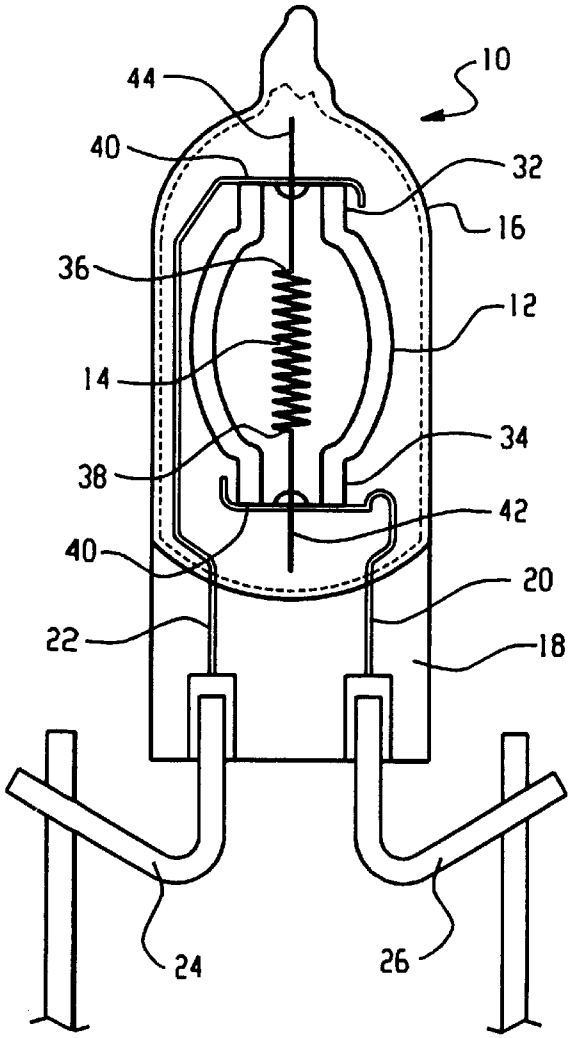
FIG. 1 is a side cross-sectional view of a lamp according to a first embodiment of the invention.

Referring now to the drawings wherein the showings are for the purposes of illustrating the preferred embodiments of the invention only and not for purposes of limiting same, FIG. 1 shows a single-ended glass halogen lamp 10 with an internally mounted ellipsoidal shaped shroud 12 surrounding a lamp filament 14 to provide maximum energy savings.

As illustrated in FIG. 1, the ellipsoidal shroud 12 and filament 14 are surrounded by an enclosure 16 formed of a light transmissive quartz or high temperature aluminosilicate glass which is capable of withstanding high temperatures of about 800° C. The enclosure 16 includes a base 18 through which the two inner lead wires 20, 22 extend. The inner lead wires 20, 22 are hermetically sealed in the base 18 and connect the filament 14 to the outer leads 24, 26. Preferably, the inner leads 20, 22 are made of a suitable refractory material such as molybdenum or tungsten and are electrically and mechanically connected to the outer leads 24, 26 by a suitable welding method.

The enclosure 16 contains an inert gas, such as argon, xenon, or krypton along with a minor amount (i.e., less than 10%) of nitrogen, one or more halogen compounds such as methyl bromide, dibromomethane, dichlorobromomethane, and the like, and a gettering material such as phosphorous.

The shroud 12 includes an ellipsoidal body portion connected to two cylindrical end portions 32, 34 which are open to the interior and the exterior of the shroud. The lamp filament 14 is mounted within the shroud 12 such that opposite ends 36, 38 of the filament are positioned at or near the foci of the ellipsoid. The position of the lamp filament 14 between the foci of the ellipsoid provides maximum energy recovery by focusing the reflected infrared energy along the length of the filament.

The ellipsoidal shroud 12 is mounted within the enclosure 16 between the inner lead wires 20, 22 by notches 40 formed in the cylindrical end portions 32, 34 of the shroud. The shorter of the two inner leads 20 is received in the notches 40 on the lower end 34 of the shroud while the longer of the two inner leads 22 is received in the notches 40 in the upper end 32 of the shroud. In addition to supporting the shroud, the inner lead wires 20, 22 cross over the open ends of the ellipsoidal shroud 12 and, at that point, are electrically and mechanically connected to the vertically extending filament leads 42, 44. The filament leads 42, 44 are preferably welded to the filament 14 by plasma welding or laser welding. The inner lead wires 20, 22 are specially shaped to support and maintain the relative position of the quartz shroud 12 with respect to the filament 14, and to maintain the position of the filament and shroud in substantially the center of the enclosure 16.

The ellipsoidal shroud is preferably a quartz shroud coated with a light transmissive, infrared reflecting filter coating of the type disclosed in U.S. Pat. No. 5,138,219, which is incorporated herein by reference. Preferably, the infrared reflecting coating includes alternating layers of $SiO_2$ and $Ta_2O_5$ applied employing an LPCVD coating process. The use of the coated shroud 12 to reflect infrared energy and increase the temperature of the lamp filament improves lamp efficiency by as much as 40%. The shroud 12 according to the present invention may be coated either on an interior or an exterior surface. However, the coating is more easily applied to the exterior surface of the shroud.

Figure 3:
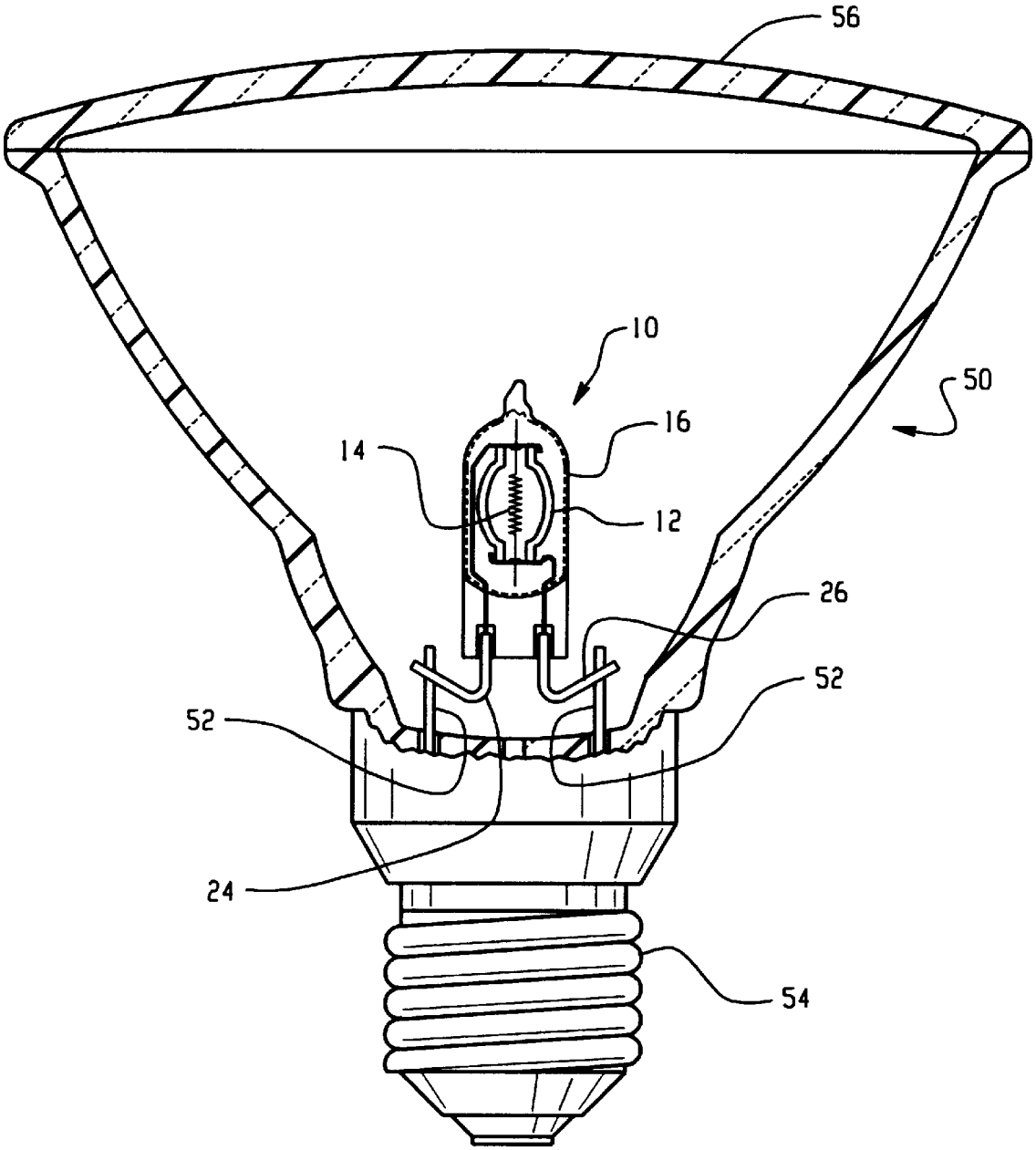
FIG. 3 is a partial cross-sectional view of the lamp of FIG. 1 mounted in a parabolic reflector.

The lamp 10 illustrated in FIG. 1 is assembled in a parabolic reflector 50 in FIG. 3. The lamp 10 is mounted into the bottom portion of the parabolic glass reflector 50 by means of conductive mounting legs 52 which project through seals at the bottom of the glass reflector 50. The mounting legs 52 are electrically and mechanically attached to the exterior leads 24, 26 of the lamp 10 by suitable means, such as welding. The lamp base 54 is a standard screw base for screwing the completed reflector and lamp assembly into a suitable lamp socket. The lamp base 54 is crimped onto the bottom portion of the glass reflector 50. A glass or plastic lens or cover 56 is attached or hermetically sealed by adhesive or other suitable means to the opposite end of the reflector 50.

Figure 2:
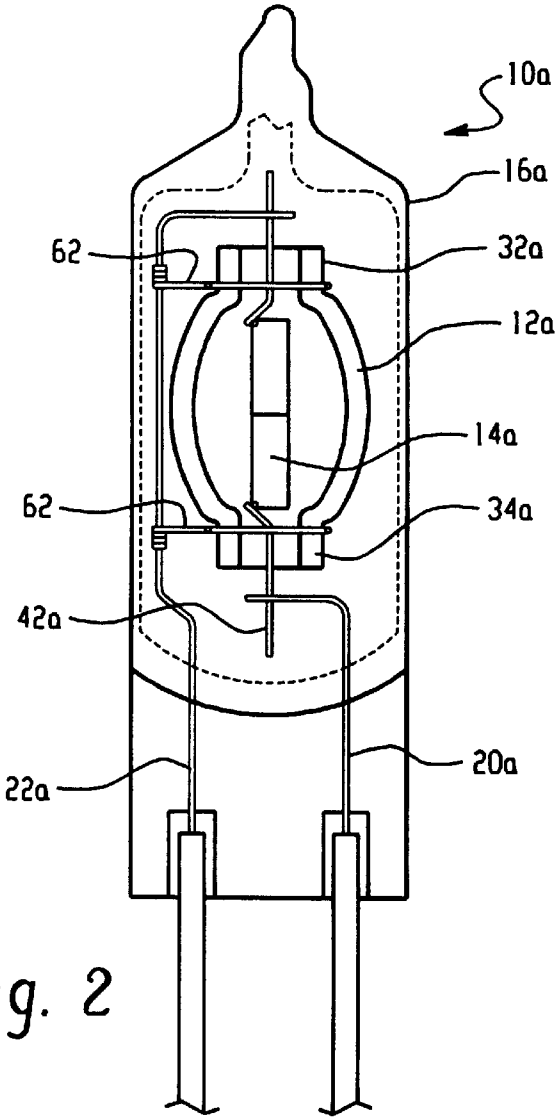
FIG. 2 is a side cross-sectional view of a second embodiment of the lamp according to the present invention.

An alternative embodiment of the lamp 10*a* according to the present invention is illustrated in FIG. 2 in which the ellipsoidal shroud 12*a* is mounted within the enclosure 16*a* in an alternative manner. The long lead 22*a* according to this embodiment includes two wire ring supports 62 fixed to a vertical portion of the long lead and positioned at a top and a bottom of the shroud 12*a*. The wire ring supports 62 are positioned around the cylindrical end portions 32*a*, 34*a* of the shroud to support the shroud in a fixed position with respect to the filament 14*a* and the enclosure 16*a*. The short lead 20*a* is connected to the filament lead 42*a* and together with the long lead 22*a* supports the filament 14*a* within the shroud.

Although the present invention has been described with respect to a glass halogen lamp with a coil-shaped filament 14, 14*a*, the coated ellipsoidal shroud 12, 12*a*, according to the present invention, may also be used with filaments of other shapes. In addition, the ellipsoidal shroud may be used to improve the efficiency of an arc discharge lamp. In an arc discharge lamp, the electrodes of the arc will be positioned within the shroud in place of the filament with the electrodes at or near the foci of the ellipsoidal shroud.

The advantages of the present invention include an efficiency which is improved by as much as 40% over a similar halogen lamp without an infrared reflecting coating. The present invention also provides advantages over known lamps in which the entire enclosure is coated with an infrared reflecting coating in that cost savings are achieved from more efficient use of the coating on the smaller shroud. In addition, more shrouds can be coated in a single coating process due to the smaller size of the shroud than if the entire enclosure is coated, thus throughput is increased. Finally, an additional cost savings is provided by the ability to modify existing equipment to make and mount the new lamp within the parabolic reflector instead of building new equipment.

The invention has been described with reference to the preferred embodiments. Obviously, modifications and alterations will occur to others upon a reading and understanding of this specification. The invention is intended to include all such modifications and alterations insofar as they come within the scope of the appended claims or the equivalents thereof.

What we claim as new and desire to secure by Letters Patent of the United States is:

1. A glass halogen lamp comprising:

a lamp filament;

a light transmissive lamp enclosure surrounding the lamp filament;

first and second electrical leads electrically connected to opposite ends of the lamp filament and both extending from a single side of the lamp enclosure;

an open ended ellipsoidal shroud centrally positioned around the lamp filament between the filament and the enclosure directly in contact with and at least one of the first and second electrical leads supporting the open ended ellipsoidal shroud within the enclosure; and, a light transmissive, infrared energy reflecting coating formed on the open ended ellipsoidal shroud to reflect infrared energy generated by the filament back to the filament to improve an efficiency of the lamp.

2. The glass halogen lamp according to claim 1, wherein the ellipsoidal shroud includes an ellipsoidal shaped central section and two cylindrical open end sections for mounting the shroud within the enclosure.

3. The glass halogen lamp according to claim 1, wherein the filament is located within the open ended shroud, with a first end of the filament positioned approximately at a first foci of the ellipsoidal shroud and a second end of the filament positioned approximately at a second foci of the ellipsoidal shroud.

4. The glass halogen lamp according to claim 3, wherein opposite ends of the open ended ellipsoidal shroud are notched and the first and second electrical leads are received in the notches to support the shroud within the enclosure.

5. The glass halogen lamp according to claim 1, wherein the first electrical lead further includes two rings which encloses opposite ends of the open ended ellipsoidal shroud to support of the shroud in a predetermined position.

6. The glass halogen lamp according to claim 1, wherein the enclosure is hermetically sealed and contains an inert gas.

7. The glass halogen lamp according to claim 1, wherein the open ended ellipsoidal shroud has a major axis, a minor axis, and two lamp light source leads extending through opposite openings, along the major axis, of the open ended shroud.

8. An electric lamp comprising:

an electric light source;

an open ended shroud coated with an optical interference coating which reflects infrared radiation and transmits visible light, the open ended shroud centrally surrounding the light source and reflecting the infrared radiation emitted by the light source back towards the light source;

first and second electrical leads electrically connected to opposite ends of the light source, at least one of the first and second electrical leads directly in contact with and supporting the open ended shroud;

a hermetically sealed envelope surrounding the open ended shroud; and an inert gas disposed within the envelope and surrounding the open ended shroud and light source.

9. The electric lamp according to claim 8, wherein the electric light source is a coil shaped filament.

10. The electric lamp according to claim 9, wherein the coil shaped filament includes filament leads which extend through openings in opposite ends of the open ended shroud.

11. The electric lamp according to claim 9, wherein the shroud is an ellipsoidal shroud with cylindrical sections surrounding the openings in the opposite ends of the open ended shroud.

12. The electric lamp according to claim 9, wherein the first and second electrical leads are electrically and mechanically connected to opposite ends of the filament.

13. The electric lamp according to claim 12, wherein the first and second electrical leads both extend through a single side of the envelope.

14. A parabolic lamp comprising:

a light source;

first and second leads extending from first and second ends, respectively, of the light source;

a hollow open ended shroud centrally surrounding the light source having a central ellipsoidal portion and a coating disposed on the ellipsoidal portion for reflecting infrared radiation emanating from the light source back toward the light source, to increase the efficiency of the lamp the first and second electrical leads electrically connected to opposite ends of the light source, at least one of the first and second electrical leads directly in contact with and supporting the open ended shroud;

an enclosure surrounding the open ended shroud and hermetically sealing the light source, the first and second leads extending from a single side of the enclosure; and, a parabolic reflector surrounding the enclosure and positioning the light source at a focal point of the reflector.

15. The lamp according to claim 14 wherein the light source is a filament oriented along the major axis of the ellipsoidal central portion of the open ended shroud.

16. The lamp according to claim 14, wherein the open ended shroud further includes first and second cylindrical portions extending from opposite ends of the ellipsoidal central portion.

17. The lamp according to claim 16 wherein the first electrical lead includes first and second ring supports received around the first and second cylindrical portions, respectively, to support the open ended shroud in the enclosure.

18. The lamp according to claim 17 wherein the first and second ring supports are secured to a first lead support that has a first end disposed adjacent the first end of the light source and a second end disposed adjacent the second end of the light source.

19. The lamp according to claim 14 wherein the light source is an incandescent source having a filament substantially aligned with a major axis of the ellipsoidal portion of the open ended shroud.

* * * * *